US009168584B2

(12) United States Patent
Babcsán et al.

(10) Patent No.: US 9,168,584 B2
(45) Date of Patent: Oct. 27, 2015

(54) METHOD OF PRODUCING A METAL FOAM BY OSCILLATIONS AND THUS OBTAINED METAL FOAM PRODUCT

(75) Inventors: Norbert Babcsán, Miskolctapolca (HU); Sándor Beke, Miskolc (HU); Péter Makk, Miskolc (HU)

(73) Assignee: BAY ZOLTAN ALKALMAZOTT KUTATASI KOZHASZNU NONPROFIT KFT., Budapest (HU)

( * ) Notice: Subject to any disclaimer, the term of this patent is extended or adjusted under 35 U.S.C. 154(b) by 347 days.

(21) Appl. No.: 13/132,679

(22) PCT Filed: Dec. 4, 2009

(86) PCT No.: PCT/HU2009/000099

§ 371 (c)(1),
(2), (4) Date: Jul. 15, 2011

(87) PCT Pub. No.: WO2010/064059

PCT Pub. Date: Jun. 10, 2010

(65) Prior Publication Data

US 2011/0262766 A1 Oct. 27, 2011

(30) Foreign Application Priority Data

Dec. 4, 2008 (HU) ..... 0800736

(51) Int. Cl.

| | |
|---|---|
| ***B01F 3/04*** | (2006.01) |
| ***B22D 25/00*** | (2006.01) |
| ***B32B 15/00*** | (2006.01) |
| ***B22D 27/08*** | (2006.01) |
| ***B32B 5/00*** | (2006.01) |

(Continued)

(52) U.S. Cl.

CPC ..... *B22D 25/005* (2013.01); *C22C 1/08* (2013.01); *C22C 18/00* (2013.01); *C22C 21/00* (2013.01); *B22F 2999/00* (2013.01); *C22C 2001/086* (2013.01); *Y10T 428/12479* (2015.01)

(58) Field of Classification Search

CPC ..... B22D 25/005

See application file for complete search history.

(56) References Cited

U.S. PATENT DOCUMENTS 3,663,668 A * 5/1972 Fairbanks ..... 264/416
5,334,236 A * 8/1994 Sang et al. ..... 75/415

(Continued)

FOREIGN PATENT DOCUMENTS

DE 4305660 A1 9/1993
EP 0680779 A1 11/1995

(Continued)

OTHER PUBLICATIONS

Machine translation of JP 05-320737. Dec. 1993.*

(Continued)

*Primary Examiner* — David Sample

(74) *Attorney, Agent, or Firm* — Wood, Herron & Evans, LLP

(57) ABSTRACT

The invention relates to a method of producing a bubbled metal foam, wherein adjusting the size of the bubbles takes place simultaneously with forming the bubbles by means of oscillations induced by longitudinal waves within the formation region of the bubbles. In this way, a decrease in bubble size which can be effected in an uncontrolled way after said bubbles had been created can be avoided.

10 Claims, 4 Drawing Sheets

(51) Int. Cl.

| | |
|---|---|
| ***C22C 1/08*** | (2006.01) |
| ***C22C 18/00*** | (2006.01) |
| ***C22C 21/00*** | (2006.01) |

(56) References Cited

U.S. PATENT DOCUMENTS

| | | | | |
|---|---|---|---|---|
| 6,998,535 | B2 | 2/2006 | Nichol | |
| 7,135,236 | B2 * | 11/2006 | Dobesberger et al. | 428/613 |
| 7,175,689 | B2 | 2/2007 | Dobesberger et al. | |
| 7,195,662 | B2 | 3/2007 | Dobesberger et al. | |
| 7,682,556 | B2 | 3/2010 | Han et al. | |
| 2003/0047036 | A1 | 3/2003 | Dobesberger et al. | |
| 2004/0033266 | A1 * | 2/2004 | Thassu | 424/489 |
| 2004/0076849 | A1 * | 4/2004 | Dobesberger et al. | 428/613 |
| 2005/0161188 | A1 | 7/2005 | Nichol | |
| 2007/0235159 | A1 | 10/2007 | Han et al. | |

FOREIGN PATENT DOCUMENTS

| | | | |
|---|---|---|---|
| JP | 57-165160 | * | 10/1982 |
| JP | H05-320737 | A | 12/1993 |
| JP | 2006176874 | A | 7/2006 |
| JP | 2009-78223 | * | 4/2009 |
| WO | 2006-021082 | A1 | 3/2006 |

OTHER PUBLICATIONS

English language translation of JP 57-165160. Oct. 1982.*

Hungarian Patent Office, Search Report dated Mar. 16, 2009 (Hungarian Application No. P0800736).

International Search Report for International Application No. PCT/HU2009/000099, dated May 27, 2010.

* cited by examiner

METHOD OF PRODUCING A METAL FOAM BY OSCILLATIONS AND THUS OBTAINED METAL FOAM PRODUCT

BACKGROUND

The present invention relates to a method of producing a metal foam, wherein to foam a metal, the size of the bubbles to be created within the bulk or on the surface of a foamable metal in the liquid phase is controlled, preferentially decreased or increased, and in particular set to a given value by means of applying oscillations simultaneously with the formation of said bubbles. The invention also relates to the metal foam product produced by the method in accordance with the invention.

Metal foams are closed-cell or open-cell constructional materials with light weight and exhibit outstanding physical, mechanical, as well as heat and acoustical insulation properties. Due to their properties, metal foams can be applied in a broad range extending from constructional materials to various ornaments. Mainly due to their low densities and extraordinary mechanical properties, some exemplary fields of use of metal foams include e.g. aircraft industry (wings, seats), space technology (heat insulation, vibration damping), automotive industry (various bumping elements, body parts, acoustical cushionings), defence industry (screenings within the radio frequency domain, strong armours), medical applications (such as osteoprostheses), as well as construction industry (frame constructions, light weight construction walls), and others.

Several techniques are known for the production of metal foams. In the most common way, a metal foam is prepared by adding a gas forming additive (such as hydrides, carbonates, and the like) to the melt of a metal also comprising stabilizing grains/particles. According to our present knowledge, due to the uncontrollability of the undergoing chemical and physical reactions, no metal foam of a monomodal pore size distribution can be produced by means of introducing gas forming additives. Another technique for producing a metal foam is to introduce gas bubbles into the melt of a metal. In general, said supply of gas bubbles is effected by means of either an agitating device (see e.g. Japanese Laid-open Patent Publication No. 2006-176874) or a suitable injection means (see e.g. U.S. Patent Application No. 20030047036).

German Patent Application No. DE 43 05 660 A1 discloses a method and an apparatus for adjusting the size of the bubbles of a bubbled medium in the liquid phase, wherein said adjustment takes place subsequently, that is, after the creation of said bubbles. The core of said method is to expose the bubbles formed in the medium by e.g. injecting a gas through a nozzle orifice to ultrasonic waves after they had detached from the nozzle and left the nozzle end; the bubbles are formed at the nozzle end with a diameter that is defined by the geometrical parameters of the nozzle end in combination with further parameters influencing the way of the injection (such as the gas flow rate and the gas injection pressure). The frequency and power of the applied ultrasonic waves are chosen in such a manner that due to the exposition the bubbles get into resonance, and as a result of that they burst into bubbles of smaller size.

European Patent Application No. 0680779 A1 teaches a method for facilitating the dissolution of a gas into a liquid kept in flowing. In said method, bubbles formed previously in the liquid by means of injecting gas through a nozzle are brought into interaction with ultrasonic waves. As a result, the bubbles within the liquid are excited to frequencies beyond the resonant frequency and then split into bubbles of smaller size due to the energy absorbed from the ultrasonic waves. The thus obtained smaller bubbles rapidly dissolve into the liquid.

Japanese Laid-open Patent Publication No. 57-165160 discloses the fabrication process of a metal tape with a porous and amorphous structure, as well as an apparatus for accomplishing said fabrication process. According to the solution taught, a molten metal is put into a closed crucible and is then injected via a nozzle onto a cooling roll that rotates at a high speed by means of exerting a pressure onto the melt within the crucible by a gas introduced into the crucible via an inlet pipe. Simultaneously, gaseous nitrogen, air or another inert gas is also blown via a gas blowing pipe into the molten metal and to said nozzle, thereby forming bubbles in the melt in the vicinity of the nozzle end. Thereafter, the bubbles detached from said nozzle are dispersed by means of mechanical vibrations generated by a high frequency generator and/or further bubbles are formed by the cavitation effect within the molten metal from the gas dissolved into said melt. Thereby, a relatively fine distribution of bubbles is achieved within the melt. The bubbled molten metal solidifies on the surface of the rotating roll very rapidly and forms an amorphous thin metal foam tape thereon.

Said fabrication process is solely suitable for the preparation of thin metal foam tapes spreading essentially in-plane and cannot be used to produce a liquid or a solid metal foam in the shape of a block (i.e. with three well-defined spatial dimensions).

A common drawback of the above discussed solutions is that they all aim at decreasing the size of previously formed bubbles in a liquid medium by means of breaking up said bubbles with ultrasonic waves. As such a technique is based on bringing into vibration the already existing bubbles by the ultrasonic waves and thereby inducing spatial deformation thereof and then tearing said bubbles into parts of smaller size at an extreme value of the deformation, this technique is not suitable for performing the break-up of the gas bubbles in a controlled manner: typically, the size of the bubbles obtained through break-up varies in a broad range, and thus, the pore size distribution of the metal foam obtained by this technique also varies between wide limits. Hence, the formation of bubbles with about the same size cannot be ensured by such a technique. Neither can be ensured the production of a metal foam with a (nearly) monomodal pore size distribution. The high frequency generator applied affects the size of the bubbles detached from the nozzle end in an uncontrollable way; the ultrasonic waves emitted by said generator will decrease the size of those bubbles of the metal foam in the liquid phase that had already previously formed.

A method and a capillary system for producing a liquid metal foam with a monomodal size distribution (here, the pore size being greater than 3 mm) from a molten metal are disclosed in European Patent No. 1419835 B1. The desired size of the pores of the liquid metal foam being formed is essentially accomplished by dimensioning the individual nozzles of the capillary system, as well as by appropriately choosing the relative distance of said nozzles and the geometrical design of the nozzle ends. Consequently, only a metal foam of a certain pore size can be obtained by a capillary system of a given geometry—the preparation of metal foams of different pore sizes requires the application of capillary systems of several geometries.

A further common drawback of the above solutions is that a gas injection via one or more nozzles, used as a tool to create the bubbles, forms an essential element thereof.

SUMMARY

The aim of the present invention is to eliminate the above discussed drawbacks. In particular, our aim is to provide a method of producing a metal foam from the melt of a foamable metal wherein setting the size of the bubbles takes place simultaneously with the creation of said bubbles and in a fully controlled manner, and hence, there is no need for a subsequent uncontrollable break-up of the bubbles that would be performed after their formation. Our further aim is to produce a metal foam with a monomodal pore size distribution. Our yet further aim is to provide a method of producing a metal foam, wherein the formation of bubbles of nearly the same size does not require the application of a nozzle/nozzle system of a peculiar geometry. Moreover, our yet further aim is to provide a gas injection assisted method of metal foaming wherein the bubble size can be changed independently of the geometrical design (such as the inner diameter) of the nozzle/nozzles used when the bubbles constituting the pores of the metal foam are generated; putting this another way, metal foams with different average pore sizes can also be produced by making use of a nozzle of a given inner diameter. A yet further aim is to provide such a metal foaming method by means of which a plastic or solid metal foam in the shape of a block can easily be produced as well.

The present invention is based on the finding that the bubble size cannot be adjusted in a desired and controlled manner in a bubble creation accomplished in accordance with any of the known prior art techniques.

The burden of the present inventive solution is that "growing" of bubbles created on the surface or within the bulk of a molten metal when foaming a foamable metal in the liquid phase takes place all through in the presence and under the influence of an external force differing from the forces acting upon anyway the bubbles during their formation (such as the buoyancy and the surface tension). Said external force is provided in the form of oscillations induced by longitudinal waves that are generated by a generator and applied in the bubble formation zone, i.e. within the so-called interaction region. Consequently, the bubble size itself is controlled/adjusted to a desired value by means of said external force in the course of the actual bubble creation.

When a molten metal is subjected to a foaming on its surface, through cavitation, due to the oscillations representing the external force, significantly smaller bubbles are formed by the bubble forming means on the surface of the melt than in the case of bubble formation in lack of oscillations. When a molten metal is subjected to a foaming within its bulk volume, a gas is injected into the melt through a nozzle representing the bubble forming means and the external force at issue is exerted by the oscillations on the bubbles just detaching from the nozzle surface in the interaction region simultaneously with creating said bubbles. As a result, depending on the energy carried by the applied longitudinal waves, preferentially ultrasonic waves, and chosen on the basis of the nature of the molten metal to be foamed and the properties of the metal foam to be achieved by foaming said molten metal, bubbles get detached from the nozzle with much smaller diameters than those obtainable in the case of bubble formation in lack of oscillations. Moreover, in this latter case the guided ultrasonic waves merely "shove down" the bubble from the nozzle, but do not endamage the forming metal foam.

In summary, when a metal foam is prepared by the method according to the invention, there is no need for a subsequent cut/break-up of the bubbles in an uncontrollable manner, and therefore a metal foam characterized by a fairly even bubble diameter and of a plastic consistency can be obtained.

In one of the aspects, the present invention relates to a method of producing a metal foam as set forth below. Preferred embodiments of the inventive method are defined as also set forth below.

To induce oscillations, a generator capable of generating and emitting longitudinal waves, preferentially an acoustic radiation source, and an oscillation means coupled appropriately to said generator are used. In the case of surface foaming, said oscillation means also serves as a bubble forming means. In the case of bulk (or volumetric) foaming, the oscillation means and the bubble forming means can also be provided as means spatially separated from one another. Said oscillations can be realized in a wide frequency range, said frequency range falls preferably into the ultrasonic frequency domain; a frequency range extending between 20 kHz and 10 MHz is preferred, however, the range from 24 kHz to 2 MHz is even more preferred. The oscillations can be induced by either a continuous or a pulsed generator.

In a further aspect, the present invention relates to metal foams obtained by an embodiment of an inventive method. Metal foams produced by the method according to the invention are provided in the shape of a block and exhibit a plastic consistency. Furthermore, they have got a monomodal pore size distribution. Due to their plasticity, said metal foams are suitable for being subjected to shaping; they can be formed to any desired shape (such as to a plate or to the shape of any other spatial objects) by means of e.g. casting, extrusion, rolling/calendaring, and optionally by injection moulding. Said shaping of the metal foams can be performed previously to, simultaneously with or subsequently to their solidification. As it is known by a skilled person in the art, the metal foams produced by the method in accordance with the invention can be solidified by any suitable techniques. When in the liquid phase, the metal foams according to the invention can also be applied to any selected surface by means of a suitable coating process.

BRIEF DESCRIPTION OF THE FIGURES

In what follows, the invention is discussed in more detail with reference to the attached drawings, wherein.

DETAILED DESCRIPTION

Figure 1:
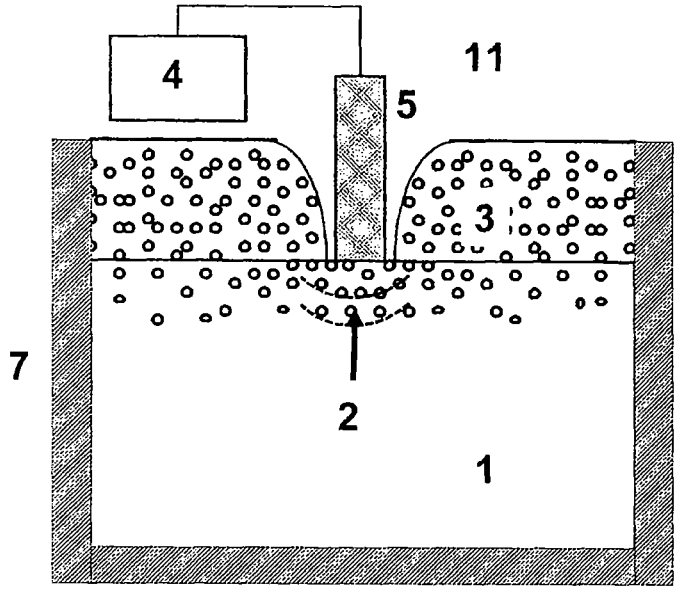
FIG. 1 illustrates schematically an arrangement to achieve surface foaming as a possible embodiment of the method according to the invention.

FIG. 1 shows schematically a preferred embodiment (surface foaming) of the production method of a metal foam 3 in accordance with the invention. In this embodiment, stabilized, foamable molten metal 1 is arranged in a suitable container, for example in a properly formed crucible 7. The crucible 7 is formed so as to maintain the molten metal 1 in the liquid phase throughout the duration of the foaming. To this end, e.g. the wall of the crucible 7 is provided with at least one heating member, preferably a heater filament, of a given heating output power to keep the molten metal 1 at a constant temperature. In turn, the wall of the crucible 7 can also be provided with an appropriate cooling member to allow solidification of the finished metal foam 3, if required. The molten metal 1 arranged in said crucible 7 is in direct contact at its free surface with a gas 11, preferably with air or with an inert gas atmosphere.

To produce the metal foam 3, an oscillation means 5 is brought into contact with the molten metal 1 within the crucible 7 in a given interaction region. In this peculiar embodiment of the method according to the invention, said interaction region is located essentially at the interface between the molten metal 1 and the gas 11, or in the vicinity thereof.

The oscillation means 5 is connected to a generator 4 apt for generating and emitting longitudinal waves. Said generator 4 is preferably provided in the form of a variable power acoustic radiation source capable of emitting over a wide frequency range. The operational frequency range of said generator 4 falls preferably into the ultrasonic frequency domain. The range between 20 kHz and 10 MHz is highly preferred, however, a frequency range extending from 24 kHz to 2 MHz is even more preferred. Said generator 4 can either be a continuous or a pulsed mode generator. The coupling between the generator 4 and the oscillation means 5 is realized in such a way that longitudinal waves generated by said generator 4 could be transmitted through said coupling to a region of the oscillation means 5 that can be brought into contact with said molten metal 1 in order to make said region oscillate.

For the inventive method accomplished in harmony with FIG. 1, the oscillation means also functions as a bubble forming means. After activating the generator 4, said region of the oscillation means 5 is put into oscillation and thereby bubbles 2 are created within the interaction region on the part of said oscillation means 5 which contacts the molten metal 1. Oscillations influence the formation of bubbles 2 and/or the amount of gas absorbed by said bubbles 2 from the gas 11. That is, the actual size of the bubbles 2 is determined by the oscillation intensity. The bubbles 2 being formed due to the oscillations (of high-energy, i.e. falling above the cavitation limit) induced within the interaction region constitute the metal foam 3 on top of the molten metal 1. The thus obtained metal foam 3 consists of bubbles 2 that were "grown" in a controlled manner; the size of said bubbles 2 (and hence also of the pore size of the metal foam 3)—in accordance with the Examples discussed later on—can even decrease to the range of microns. Moreover, the thus formed metal foam 3 is of plastic consistency, can easily be shaped in the liquid phase too and takes the shape of a block.

Figure 2:
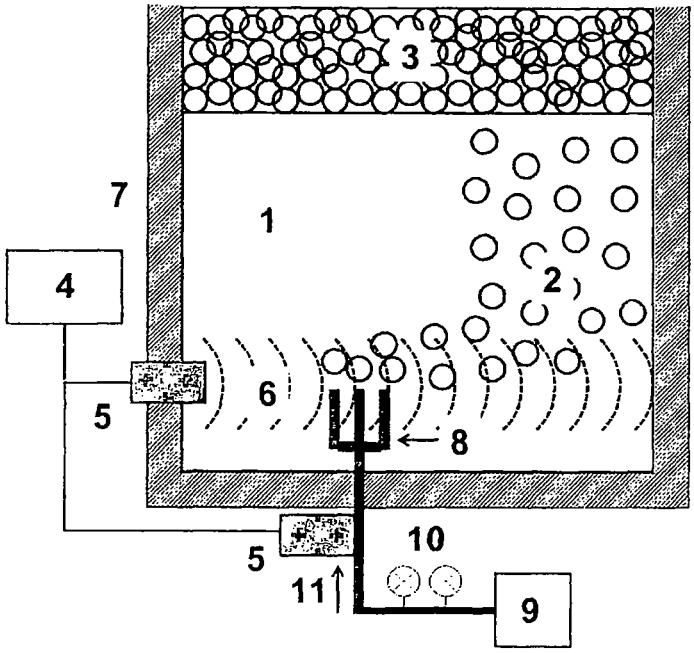
FIG. 2 shows schematically an arrangement to achieve bulk foaming as a possible further embodiment of the method according to the invention, wherein said foaming takes place along with gas injection.

FIG. 2 shows schematically a preferred embodiment (bulk foaming) of the production method of a metal foam 3 in accordance with the invention. In this embodiment, the stabilized, foamable molten metal 1 is arranged in the container formed by the crucible 7 detailed with reference to FIG. 1, and hence is not discussed in more detail.

Furthermore, in this embodiment of the inventive method, a bubble forming means is submerged into the molten metal 1 at the given interaction region, and the bubble forming means is provided in the form of a nozzle 8 with a bubble forming end. Said bubble forming means may comprise one or more nozzles. Here, said interaction region is formed by a volume portion of said molten metal 1.

Inner and outer diameters of said nozzle 8 are fixed. The nozzle 8 is connected via a suitable conduit through its end located opposite to the bubble forming end thereof to a gas tank 9 arranged preferentially outside of the crucible 7. The gas tank 9 stores the gas 11 used when performing bubble formation. The pressure and the flow rate of the gas 11 used for bulk foaming are adjusted by a control unit 10 inserted into said conduit. Within the arrangement of FIG. 2, the nozzle 8 is introduced into the molten metal 1 through an appropriately sealed opening formed in the bottom of the crucible 7 and its bubble forming end faces towards the free surface of the molten metal 1. As it is clear for a skilled person in the art, the nozzle 8 can be arranged within the crucible 7 at any position and with an arbitrary orientation.

In the present embodiment of the inventive method, the oscillation means 5 coupled to the generator 4 (discussed in detail with reference to FIG. 1) is provided in the form of a separate device differing from said bubble forming means 8. The oscillation means 5 can be arranged in any positions inside or outside of the crucible 7 in which the longitudinal waves emitted by the generator 4 are applied (in particular focussed) into the contact zone of the bubble forming means 8, or more precisely of its bubble forming end and said molten metal 1, that is, into the interaction region. Hence, the oscillations also exert their influence just in this region.

To perform bulk foaming of the molten metal 1, gas 11 is transported from the gas tank 9 through the conduit to the nozzle 8 at an injection pressure and with a flow rate set by the control unit 10. The injected gas 11 leaves through the bubble forming end of said nozzle 8 within the interaction region into the molten metal 1 in the form of bubbles 2. Simultaneously with bubbling the gas 11, longitudinal waves of a power according to needs are generated by the generator 4 and emitted via the oscillation means 5 to the bubble 2 being just formed within the interaction region. In this way, oscillations 6 (preferably of middle-energy, i.e. falling below the cavitation limit) are induced at the place of bubble formation within the molten metal 1 and/or in the bubble forming end of the nozzle 8 and/or within the gas 11 injected through the bubble forming end, by means of which the size of the bubble 2 being just created is determined. The thus formed bubbles 2 accumulate on the free surface of the molten metal 1 and constitute the metal foam 3. The thus obtained metal foam 3 consists of bubbles 2 that were "grown" in a controlled manner; the size of said bubbles 2 (and hence also of the pore size of the metal foam 3)—in accordance with the Examples discussed below—will fall into to the millimeter or sub-millimeter range or even below, into the micron range. Moreover, the thus obtained metal foam 3 is of plastic consistency, can easily be shaped in the liquid phase too and takes the shape of a block.

An advantage of the inventive solution is that, in comparison with prior art bubble formation techniques, the size of the bubbles building up the metal foams can be adjusted in a relatively precise manner by means of the oscillations applied simultaneously with the creation of said bubbles. In particular, compared to the metal foams obtained by the known prior art techniques, metal foams with smaller pore sizes can be produced, and even in bulky form, by any of said surface and bulk foaming processes. Moreover, as it is reflected by the data in Table 1 to be explained in relation to Example 1 later on, the pore size of a metal foam to be produced by the foaming methods according to the invention can be controlled by means of varying the power density of said oscillations that are induced through the oscillation means with the longitudinal waves excited by the generator, even in such a case when a single nozzle diameter is used solely. Neither are required nozzle designs of sophisticated geometry. The metal foam of plastic consistency produced by the method in accordance with the invention can easily be shaped and/or it can be transformed into a product with the shape of a block by solidifying it in any suitable manner known by a skilled person in the art.

In what follows, the foaming methods according to the invention are illustrated by way of some non-limiting examples.

Example 1

Air is bubbled through the nozzle 8 provided in the form of a non-reagent capillary at the injection pressure of 1.41 kPa into Wood's metal put into a container in accordance with the arrangement of FIG. 2 discussed earlier and melted at 70° C. The inner and outer diameters of the bubble forming end of said nozzle 8 are 1.3 mm and 2.3 mm, respectively. When an ultrasound with a frequency of f=30 kHz and an ultrasonic power density of 160 W/cm$^2$ was applied to said capillary in a direction parallel with its longitudinal extension, the diameter of the bubbles being formed decreased from 8.5 mm to 1.8 mm. Simultaneously, the bubble form ation frequency (that is, the reciprocal value of the bubble formation time measured in case of a single bubble) took the value of 108 Hz.

Figure 3A:
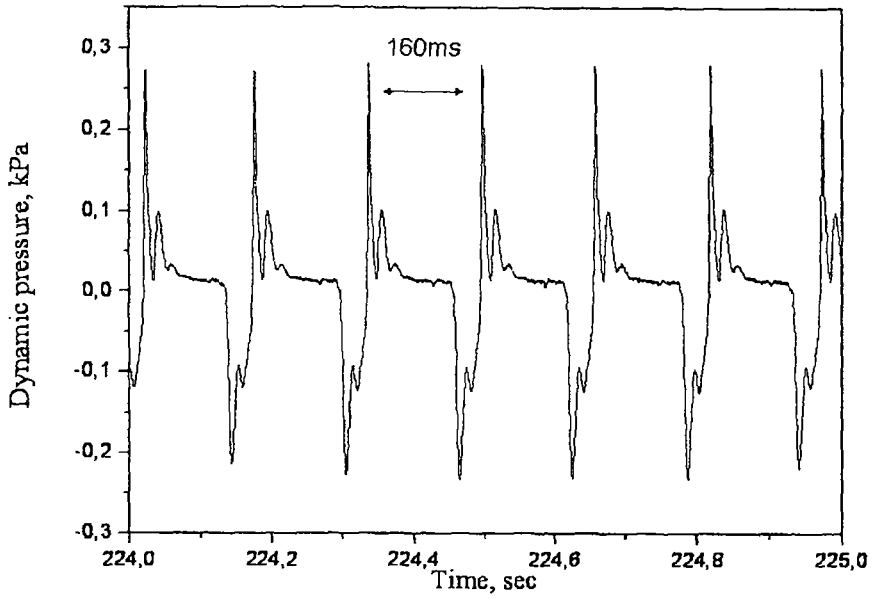
FIGS. 3A and 3B represent the dynamic pressures measured at the bubble forming end of the nozzle as a function of time in case of bulk foaming effected with and without, respectively, the application of oscillations.
Figure 3B:
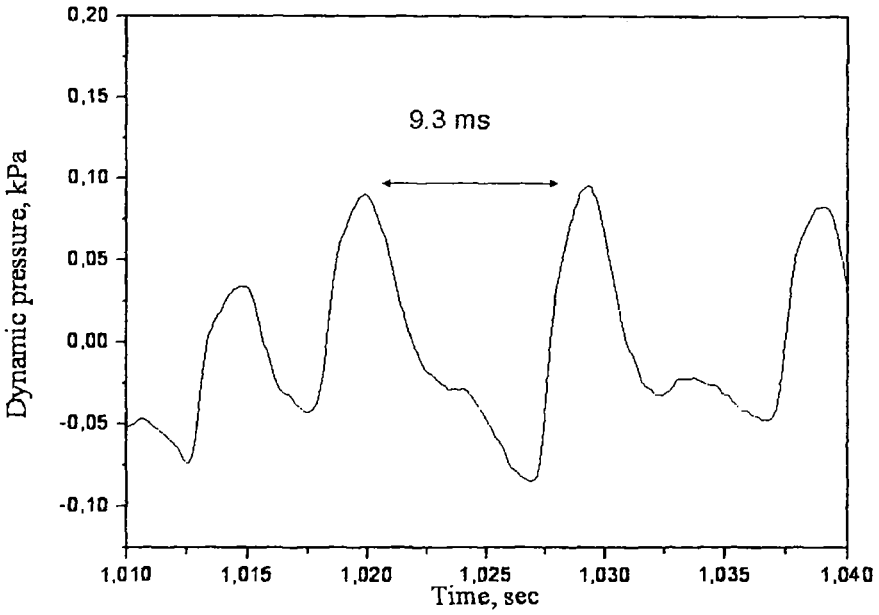

When during bubbling, the dynamic pressure prevailing at the bubble forming end of the capillary (that is, within the bubble building up) is measured as a function of time and then the measuring data are plotted graphically, the length of the time period required for a bubble to fully build up (i.e. the bubble formation time) can be read off from the obtained plot—it is actually the time taken between the appearance of two consecutive peaks of the dynamic pressure measured. Here, the dynamic pressure values (in kPa units) plotted against the time taken (in ms units) before and after the application of the ultrasound in the present arrangement are shown in FIGS. 3A and 3B, respectively. The curves clearly show that in this case the bubble formation time, as well as the bubble size significantly decrease due to the oscillations induced simultaneously with the build-up of bubbles through the application of the ultrasound.

Figure 4:
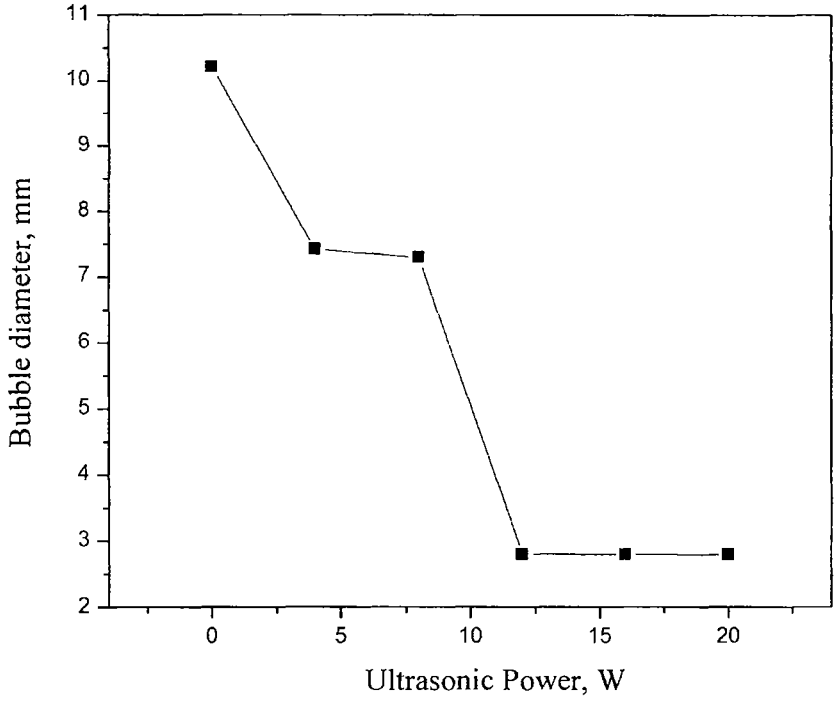
FIG. 4 illustrates the achieved bubble size as a function of the intensity of oscillations applied to achieve bulk foaming.

After this, using the same arrangement, during bubbling various ultrasonic power densities were applied to the capillary one after the other and the diameters of the bubbles thus formed were measured. The measuring results are summarized in Table 1. Ultrasonic power density dependence of the bubble size is illustrated in FIG. 4.

TABLE 1

Change in pore size in a metal foam for various ultrasonic powers at a constant ultrasonic frequency [f = 30 kHz], when bulk foaming is performed with a nozzle of unchanged geometry. Here, the inner and outer diameters of the bubble forming end of said nozzle were 0.8 mm and 4.0 mm, respectively, while its sectional area was about 0.126 cm$^2$.

| Ultrasonic Power (W) | Static Pressure (kPa) | Gas Flow Rate (ml/min) | Average Bubble Formation Frequency (Hz) | Average Bubble Formation Time (ms) | Measured Average Bubble Diameter (mm) |
|---|---|---|---|---|---|
| 0 | 2.51 | 146.9 | 12 | 83.3 | 10.2 |
| 4 | 3.05 | 146.97 | 20 | 50.0 | 7.42 |
| 8 | 3 | 146.82 | 22 | 45.5 | 7.29 |
| 12 | 3.25 | 147 | 100 | 10.0 | 2.8 |
| 16 | 3.36 | 146.86 | 100 | 10.0 | 2.8 |

TABLE 1-continued

Change in pore size in a metal foam for various ultrasonic powers at a constant ultrasonic frequency [f = 30 kHz], when bulk foaming is performed with a nozzle of unchanged geometry. Here, the inner and outer diameters of the bubble forming end of said nozzle were 0.8 mm and 4.0 mm, respectively, while its sectional area was about 0.126 cm$^2$.

| Ultrasonic Power (W) | Static Pressure (kPa) | Gas Flow Rate (ml/min) | Average Bubble Formation Frequency (Hz) | Average Bubble Formation Time (ms) | Measured Average Bubble Diameter (mm) |
|---|---|---|---|---|---|
| 20 | 3.34 | 146.95 | 104 | 9.6 | 2.79 |

Example 2

In the arrangement of Example 1, air is bubbled through a non-reagent capillary—with an inner diameter of 0.6 mm and an outer diameter of 0.9 mm—at the injection pressure of 3.03 kPa into Wood's metal melted at 70° C. When an ultrasound with a frequency of f=30 kHz and an ultrasonic power density of 160 W/cm$^2$ was applied to said capillary in a direction perpendicular to its longitudinal extension, the diameter of the bubbles being formed decreased from 6.5 mm to 2.0 mm. Simultaneously, the bubble formation frequency took the value of 59 Hz.

Example 3

Figure 5:
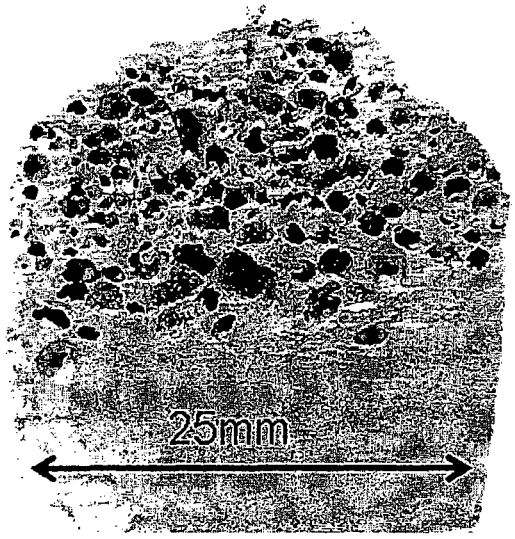
FIG. 5 is a photo of a section of a solidified aluminium foam piece produced by the method of bulk foaming in accordance with the invention and exhibiting a nearly monomodal pore size distribution.

A metal foam with a pore size of 1 mm is produced from the melt of commercial Duralcan F3S20S, an aluminium (Al) composite containing SiC particles, at the temperature of 700° C. by means of a non-reagent capillary with inner and outer diameters of 0.6 mm and 0.9 mm, respectively, by the bulk foaming technique in accordance with the invention along with the application of ultrasonic waves with a frequency of f=30 kHz and an ultrasonic power density of 160 W/cm$^2$; as injected gas, air was used. Without applying said ultrasonic waves, the bubble size that could be achieved was 6 mm. Then, the metal foam produced in this way was solidified. A photo taken of a section of the thus obtained metal foam product is shown in FIG. 5; in this figure, a nearly monomodal pore size distribution can clearly be seen.

Example 4

A metal foam is produced by injecting air as the gas at the injection pressure of 2.47 kPa through a non-reagent capillary with inner and outer diameters of 1.2 mm and 4.0 mm, respectively, into an alloy comprising 85% by weight zinc (Zn) and 15% by weight aluminium (Al) melted at the temperature of 500° C. by the bulk foaming technique in accordance with the invention. When an ultrasound with a frequency of f=30 kHz and an ultrasonic power density of 160 W/cm$^2$ was applied to said capillary in a direction parallel with its longitudinal extension, the diameter of the bubbles being formed decreased from 10.0 mm to 3.8 mm. Simultaneously, the bubble form ation frequency took the value of 13 Hz.

Example 5

Figure 6:
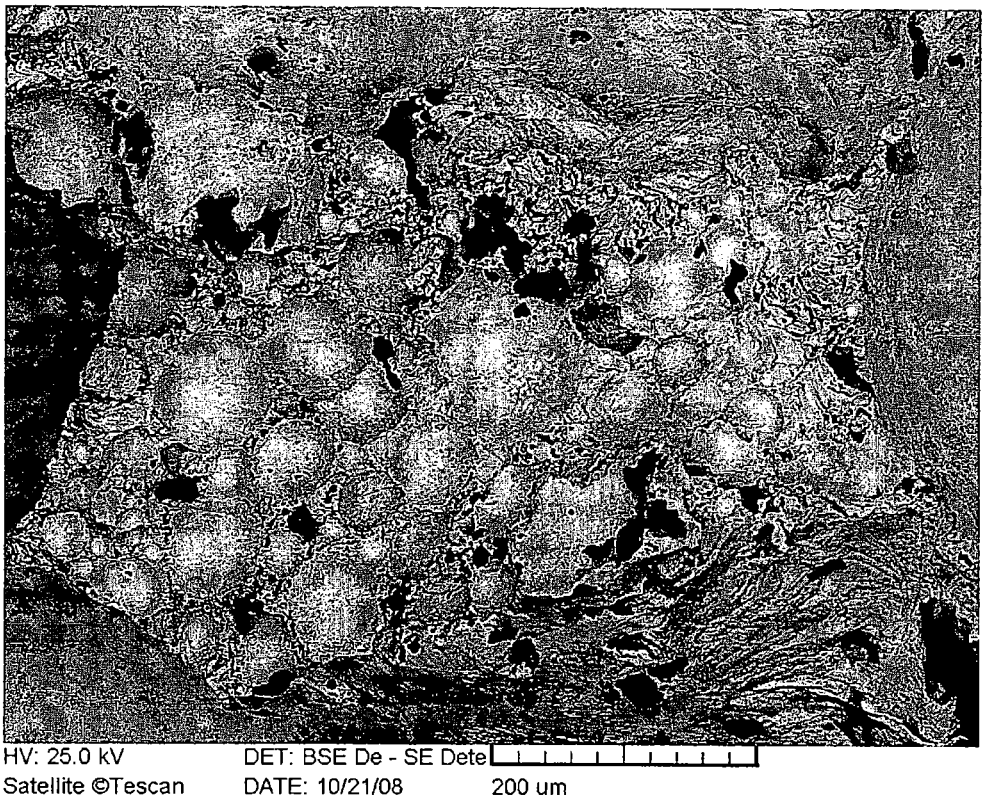
FIG. 6 is an electron micrograph of a metal foam produced from molten Wood's metal by the method of surface foaming in accordance with the invention; here, the bubbles in the order of microns created along with a simultaneous application of oscillations can clearly be seen.

To perform surface foaming of a melt, the free surface of Wood's metal put into a container in accordance with the arrangement of FIG. 1 discussed earlier in detail and melted at 70° C. was excited by ultrasonic waves having a frequency of f=30 kHz and an ultrasonic power density of 160 W/cm$^2$. Due to the oscillations induced, conical tips of the bubble forming means created sub-micron sized bubbles on the surface of the molten metal within the interaction region. The diameters of the bubbles fell into the range extending from 10 to 100 microns (μm), as it is clear from the electron micrograph of the solidified surface metal foam shown in FIG. 6.

As it is apparent to a person skilled in the art, various modifications of the method for producing a metal foam and the arrangements used to accomplish said method can be effected without departing the scope of protection claimed by the following appended claims. It should here be noted that when e.g. surface foaming is performed, said foaming can be assisted by injecting a gas at a suitable injection pressure into the interaction region if the bubble forming means used is provided with an appropriately machined inner gas passage and capable of being connected to an external gas tank.

The invention claimed is:

1. A method for producing a block of metal foam having a monomodal pore size comprising:

arranging a melt of a foamable material within a container so as to provide a free surface of the melt;

bringing a bubble forming end of a nozzle capable of injecting gas from an external source of gas into mechanical interaction with the metal melt in an interaction region of the melt and creating bubbles at the bubble forming end to be released within the interaction region, wherein the interaction region is below the free surface, and wherein the bubble forming end faces towards the free surface;

generating longitudinal waves of an energy less than a cavitation limit of the bubbles with a device that is separated from the nozzle and that is in contact with the metal melt, and introducing the longitudinal waves through the metal melt to the bubble forming end to induce oscillations within the interaction region when the bubbles are being created; and controlling the size of each of the bubbles to a controlled monomodal size value simultaneous to formation of the bubbles by detaching the bubbles from the bubble forming end only when the bubbles reach the desired monomodal size, the oscillations of the longitudinal waves acting to force bubbles to release from the bubble forming end only after reaching the desired monomodal size and without breaking the bubbles into smaller sizes, the desired monomodal size value defined by bubbles having the same size.

2. The method according to claim 1, wherein the bubble forming end is connected to an external source of gas via a gas transporting connection and the creation of bubbles is performed by bubbling gas from the external source of gas through the bubble forming end.

3. The method according to claim 1, wherein the longitudinal waves are generated by an acoustic radiation source.

4. The method according to claim 1, wherein the frequency range of the oscillations falls into the ultrasonic frequency domain.

5. The method according to claim 4, wherein the ultrasonic frequency domain corresponds to a range extending from 20 kHz to 10 MHz.

6. The method according to claim 4, wherein the ultrasonic frequency domain corresponds to a range extending from 24 kHz to 2 MHz.

7. The method according to claim 1, further comprising:

solidifying the metal foam.

8. The method according to claim 7, further comprising:

shaping the metal foam before, simultaneously with or subsequent to solidifying the metal foam.

9. The method according to claim 1, wherein the bubbles detached from the bubble forming end remain at the controlled monomodal size and are not broken apart into different sized bubbles by the longitudinal waves or other forces following detachment from the bubble forming end.

10. The method according to claim 1, wherein the generating of the longitudinal waves further comprises introducing the longitudinal waves through the metal melt in a direction perpendicular to a longitudinal extension direction of the nozzle to the bubble forming end, to thereby induce the oscillations within the interaction region.

* * * * *